US009439493B2

(12) United States Patent
Hada

(10) Patent No.: US 9,439,493 B2
(45) Date of Patent: Sep. 13, 2016

(54) HAIR DRYER AND SMOOTHER

(71) Applicant: Joan Hada, Overland Park, KS (US)

(72) Inventor: Joan Hada, Overland Park, KS (US)

( * ) Notice: Subject to any disclaimer, the term of this patent is extended or adjusted under 35 U.S.C. 154(b) by 0 days.

(21) Appl. No.: 14/596,702

(22) Filed: Jan. 14, 2015

(65) Prior Publication Data

US 2015/0122282 A1 May 7, 2015

Related U.S. Application Data

(62) Division of application No. 13/863,757, filed on Apr. 16, 2013, now Pat. No. 8,959,788.

(60) Provisional application No. 61/625,342, filed on Apr. 17, 2012.

(51) Int. Cl.

| | |
|---|---|
| ***A45D 20/12*** | (2006.01) |
| ***A45D 20/10*** | (2006.01) |
| *A45D 2/00* | (2006.01) |

(52) U.S. Cl.

CPC ..... *A45D 20/12* (2013.01); *A45D 20/10* (2013.01); *A45D 20/122* (2013.01); *A45D 2/001* (2013.01)

(58) Field of Classification Search

CPC ..... A45D 20/00; A45D 20/10; A45D 20/12; A45D 20/122; A45D 2020/128; F24H 3/0423; F26B 21/004

See application file for complete search history.

(56) References Cited

U.S. PATENT DOCUMENTS

| | | | | |
|---|---|---|---|---|
| 2,074,018 | A * | 3/1937 | Gross | 34/100 |
| 2,466,535 | A | 4/1949 | Conill | |
| 2,503,113 | A | 4/1950 | Hribar | |
| 2,718,067 | A | 9/1955 | Carson | |
| 3,046,673 | A | 7/1962 | Nawroth | |
| 3,209,386 | A | 10/1965 | Weber | |
| 4,118,874 | A | 10/1978 | Morane | |
| 4,210,162 | A | 7/1980 | Dreyer et al. | |
| 4,409,998 | A | 10/1983 | Bauer | |
| 5,444,215 | A | 8/1995 | Bauer | |
| 5,956,863 | A | 9/1999 | Allen | |
| 6,925,728 | B2 | 8/2005 | Busa et al. | |
| 7,093,376 | B2 | 8/2006 | Regen | |
| 7,204,038 | B2 | 4/2007 | Santhouse | |
| 2011/0277335 | A1 | 11/2011 | Prehodka | |

FOREIGN PATENT DOCUMENTS

| | | |
|---|---|---|
| CA | 2083086 | 5/1994 |
| KR | 10-0133514 | 4/1998 |

OTHER PUBLICATIONS

International Search Report and Written Opinion dated Jul. 1, 2013, in the corresponding PCT/US2013/036760 filed Apr. 16, 2013.

* cited by examiner

*Primary Examiner* — Jiping Lu

(74) *Attorney, Agent, or Firm* — Hovey Williams LLP

(57) ABSTRACT

Apparatus (10) for drying and smoothing hair is provided. The apparatus (10) generally comprises a hair-treatment device (16), a vacuum assembly (20) and a blower assembly (22). The hair-treatment device (16) includes a passage (64) for directing a drying-air stream (66) generated by the blower assembly (22) toward the hair of a subject, and a passageway (76) for directing a return-air stream (74) away from the subject's hair under a motive force supplied by the vacuum assembly (20). The device (16) further includes a smoothing element (42) having a surface (52) against which the hair may be contacted to achieve smoothing of the hair.

15 Claims, 10 Drawing Sheets

HAIR DRYER AND SMOOTHER

RELATED APPLICATION

The present application is a divisional of the U.S. application Ser. No. 13/863,757 filed Apr. 16, 2013, entitled HAIR DRYER AND SMOOTHER, which claims the benefit of U.S. Provisional Patent Application No. 61/625,342, filed Apr. 17, 2012. All of the foregoing applications are hereby incorporated by reference in their entireties.

BACKGROUND OF THE INVENTION

1. Field of the Invention

The present general inventive concept relates to an apparatus for drying and smoothing hair. Particularly, the apparatus comprises structure for dual-directional air-handling. A portion of the air-handling structure serves as a conduit for directing a flow of air, preferably heated air, from within the device toward a device outlet that is configured for placement adjacent the user's head. Another portion of the air-handling structure serves as a conduit for directing a flow of air away from the user's head and into the device via a return-air inlet. The flow of air into the return-air inlet creates a suction that pulls the user's hair toward a hair-smoothing surface.

2. Description of the Prior Art

A variety of devices exist that are useful in hair styling applications. Hair straightening devices are exemplary hair styling devices, and often comprise a pair of hinged arms with a pair of heated styling heads mounted on the free ends of the arms. The styling heads present a pair of facing styling surfaces. Hair is typically styled using these devices by placing the hair in between the styling heads and a compressive force is applied. It is common, though, that the hair must be dry prior to use of these types of devices. Drying of the hair may be accomplished by letting the hair air dry, which can take considerable time depending on hair length and leave the hair limp and wavy, or through the use of an electromechanical hair dryer that blow air, especially hot air, toward the hair. The latter method is generally preferred, as the use of a hair dryer can tend to give body to the hair at the roots and avoid a limp appearance.

In addition to being generally a time-consuming, two-step process, drying and smoothing of hair using these conventional devices can result in damage to the hair if not used correctly. Although heated styling heads, such as found on a conventional flat iron, provide a useful and convenient means for hair styling, the degree and duration of heating required is known to be damaging to hair. Therefore, a need exists for a more efficient means of accomplishing drying and smoothing of hair in a manner that minimizes the risk of damaging the hair through application of excessive heat.

SUMMARY OF THE INVENTION

The present invention overcomes the above problems by providing a hair-treatment device that can accomplish drying and smoothing of hair in a single, low-impact operation. According to one embodiment of the present invention there is provided a hair-treatment device comprising a housing having first and second end regions. The first end region is configured for attachment to a blower assembly capable of supplying a drying-air stream to the device. The second end region comprises an outlet for the drying-air stream supplied by the blower assembly and an air intake for directing a return-air stream into the housing. The housing includes a passage interconnecting the first end region and the outlet through which the drying-air stream supplied by the blower assembly is conducted. The housing also includes a passageway interconnecting the air intake with the first end region through which the return-air stream is conducted within the device. The device also comprises a smoothing element disposed in covering relationship to the air intake and has a hair-smoothing surface that faces away from the passageway.

According to another embodiment of the present invention there is provided a hair-treatment device comprising a blower assembly operable to supply a drying-air stream flowing in a first direction, and a vacuum assembly operable to supply a return-air stream flowing in a second direction that is different from the first direction. The device also includes a housing having a passage operably connected with the blower assembly and an outlet through which the drying-air stream is delivered. The housing further includes a passageway operably connected with the vacuum assembly and has an air intake through which the return-air stream is directed. A smoothing element is disposed in covering relationship to the air intake and has a hair-smoothing surface that faces away from the passageway.

In yet another embodiment according to the present invention there is provided a method of drying and smoothing hair. A hair-treatment device as described herein is provided. The vacuum assembly of the device is actuated so as to generate the return-air stream. The device is then placed adjacent to the head of a person whose hair is to be dried and/or smoothed, so as to cause at least a portion of the hair to be brought into contact with the smoothing element by the return-air stream generated by the vacuum assembly. The device is traversed over the hair in a substantially linear motion toward the ends of the hair thereby simultaneously drying and smoothing the hair.

DETAILED DESCRIPTION OF THE PREFERRED EMBODIMENT

The following description sets forth exemplary embodiments of the present invention. It is to be understood, however, that these embodiments are provided by way of illustration and nothing therein should be taken as a limitation upon the overall scope of the invention.

Figure 1:
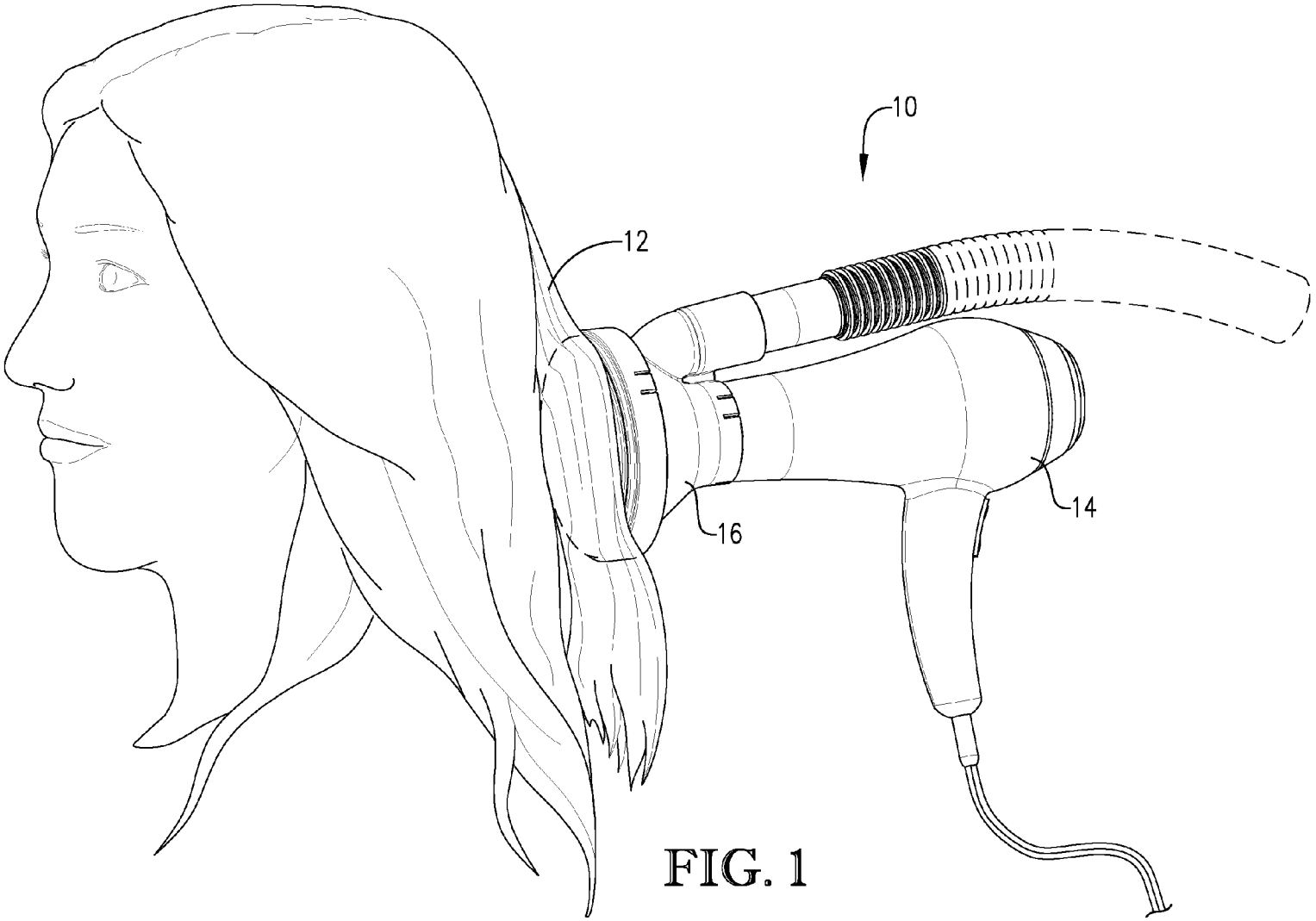
FIG. 1 is an environmental view of an apparatus according to the present invention being used to dry and smooth the hair of a subject.

The present invention generally pertains to a personal grooming device that is operable to dry and/or smooth hair. Turning now to FIG. 1, a hair-treatment apparatus 10 in accordance with one embodiment of the present invention is shown being used to dry and smooth the hair 12 of a subject. As illustrated, apparatus 10 comprises a conventional hair dryer 14 that is equipped with a hair-treatment attachment 16. These devices are described in greater detail below.

Figure 2:
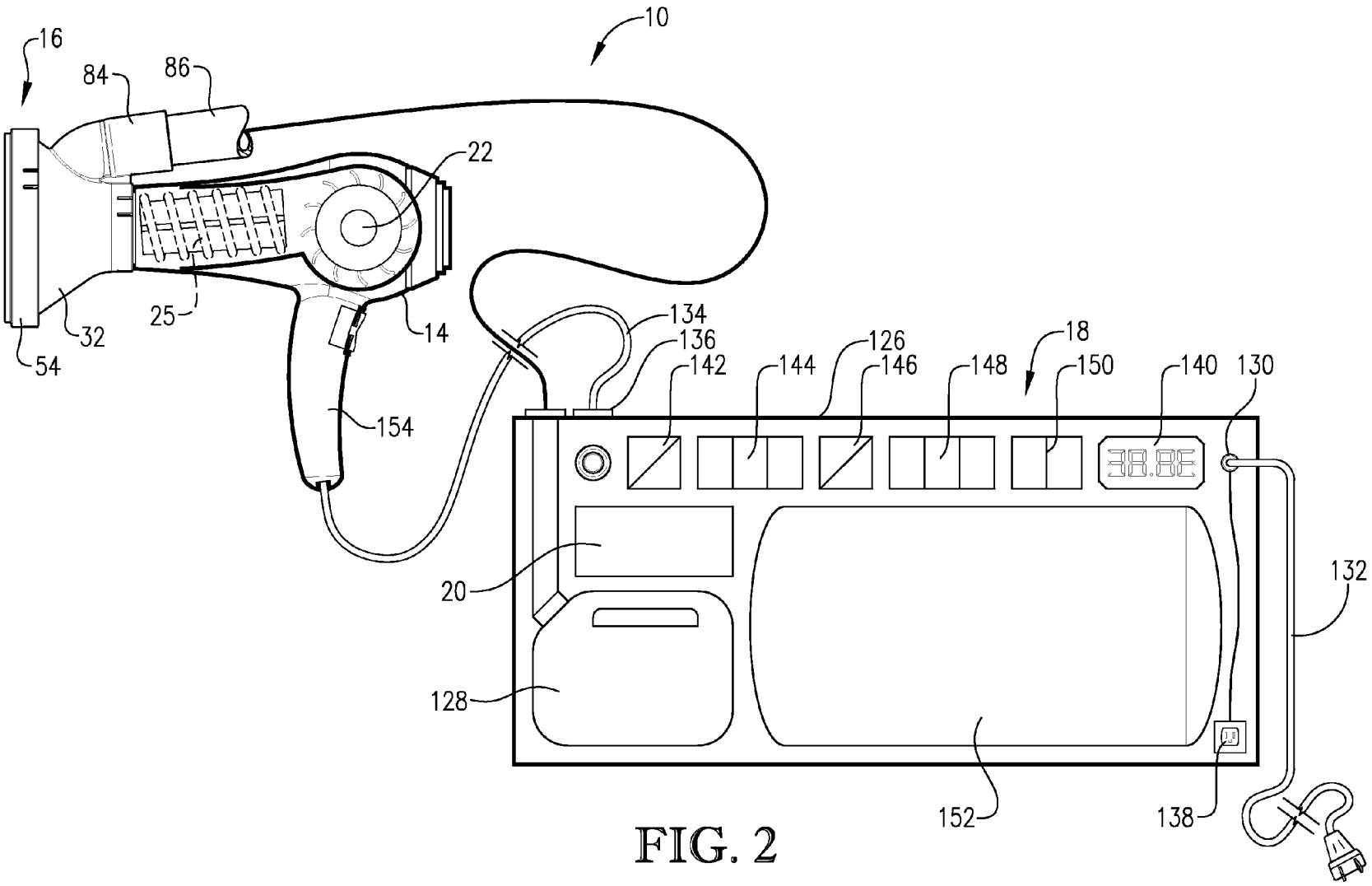
FIG. 2 is a schematic view of one embodiment of the present invention comprising a hair-treatment device attached to a conventional blow drier and operably connected to a control unit including a vacuum assembly operable to provide suction for the hair-treatment device.

Also referring to FIG. 2, apparatus 10 further comprises a control unit 18 that includes a suction or vacuum-generating assembly 20, which may in certain embodiments include an electric motor and fan assembly. Being a conventional hair dryer, device 14 includes an on-board blower assembly 22 comprising an electric motor and fan. Likewise, it is within the scope of the present invention for vacuum assembly 20 to be located within the hand-held hair dryer unit. Moreover, it is within the scope of the present invention for dryer 14 and attachment 16 to be of a unitary construction, rather than a two-piece, detachable assembly. In such embodiments, attachment 16 comprises a nozzle for dryer 14. In addition, blower assembly 22 may also comprise a heating element 25 for heating the stream of air generated thereby.

Figure 3:
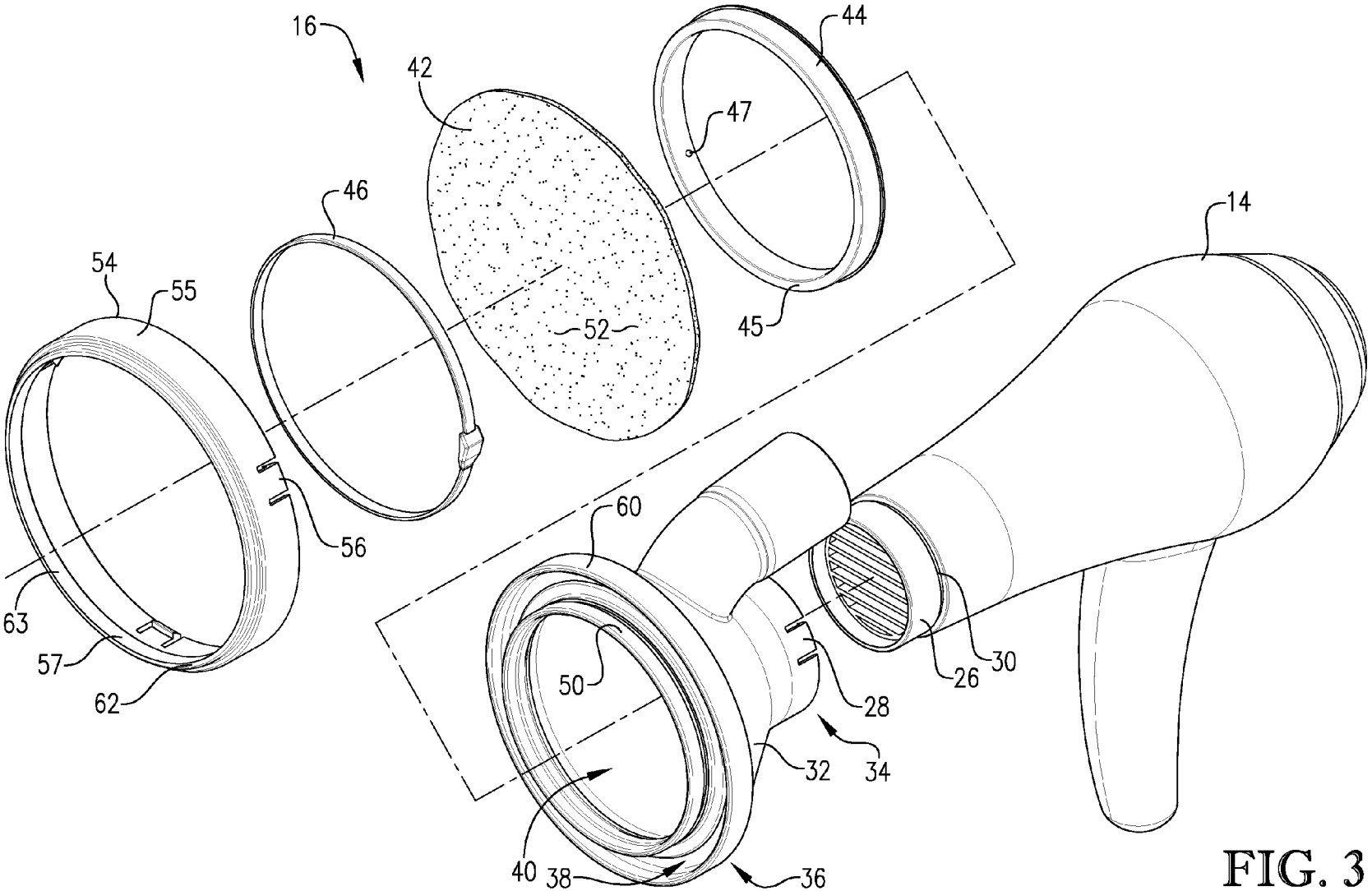
FIG. 3 is an exploded view of a hair-treatment device made in accordance with one embodiment of the present invention.

As shown in FIG. 3, attachment 16 is configured to be received on and secured to nozzle 26 of hair dryer 14 via coupling structure 28. As illustrated, coupling structure 28 comprises one or more releasable tabs configured to engage a circumscribing channel 30 formed in the outer surface of nozzle 26. Although, it is within the scope of the present invention for alternate coupling structure to be used for this purpose including structure that frictionally secures attachment 16 to nozzle 26.

Attachment 16 generally comprises a housing 32 having a first end region 34 that includes coupling structure 28, and a second end region 36 that comprises an outlet 38 for a drying-air stream supplied by blower assembly 22 and an air intake 40 for directing a return-air stream into housing 32. Attachment 16 further comprises an air-permeable smoothing element 42 that is secured to a support ring 44 via a clamp 46. Element 42 may comprise any porous material that is capable of transmitting air therethrough, but does not permit the hair to otherwise enter the attachment 16. In exemplary embodiments, element 42 may comprise a woven or unwoven, natural or synthetic textile material, such as cloth or a fibrous pad, or a material having a cellular structure formed of a natural or synthetic material, such as a sponge or foam. In certain embodiments, element 42 may take the form of a flexible film or membrane, but it is also within the scope of the present invention for element 42 to comprise a more rigid, relatively impervious material that includes a plurality of apertures for permitting air to pass through. Ring 44 is configured to be releasably attached to housing 32 at second end region 36. Ring 44 may include a plurality of buttons 47 projecting from the inner surface thereof that are configured to be received in recesses 48 (see, FIG. 4) formed in an inner cylindrical wall section 50 located proximate air intake 40. Element 42 is disposed in substantially covering relationship to air intake 40 and has a substantially planar hair-smoothing surface 52. In certain embodiments, support ring 44 may comprise a slightly "bowed" outer edge 45. In such embodiments, portions of outer edge 45 present an elevation that is different from other portions of the edge thereby causing smoothing surface 52 to assume a slightly curved configuration. This curved configuration helps prevent the smoothing surface 52 from becoming entirely adhered to the user's head by the suction forces created by vacuum assembly 20.

Figure 4:
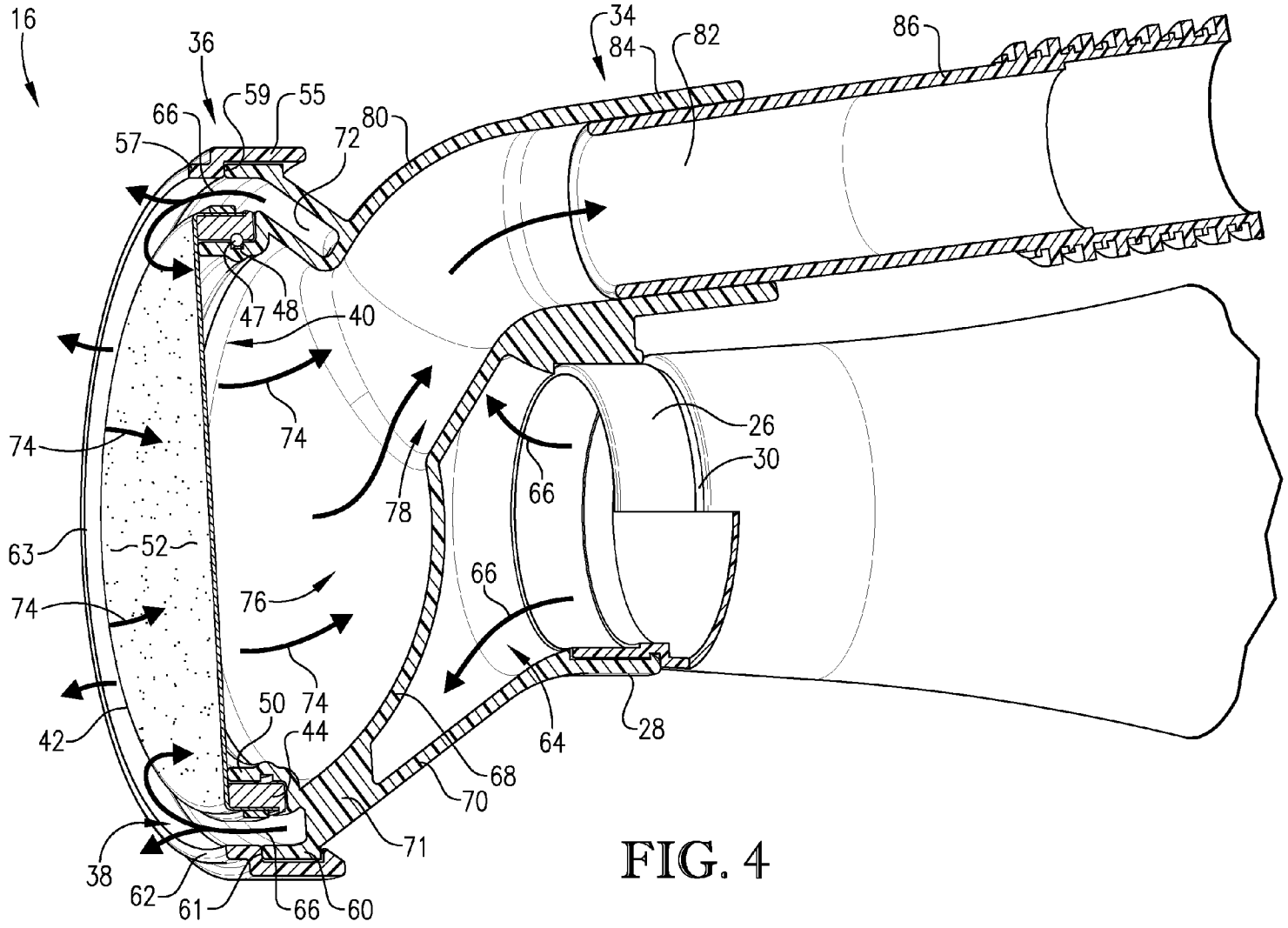
FIG. 4 is a cross-sectional view of a hair-treatment device in accordance with the present invention illustrating the directional air flows within the device during operation.
Figure 5:
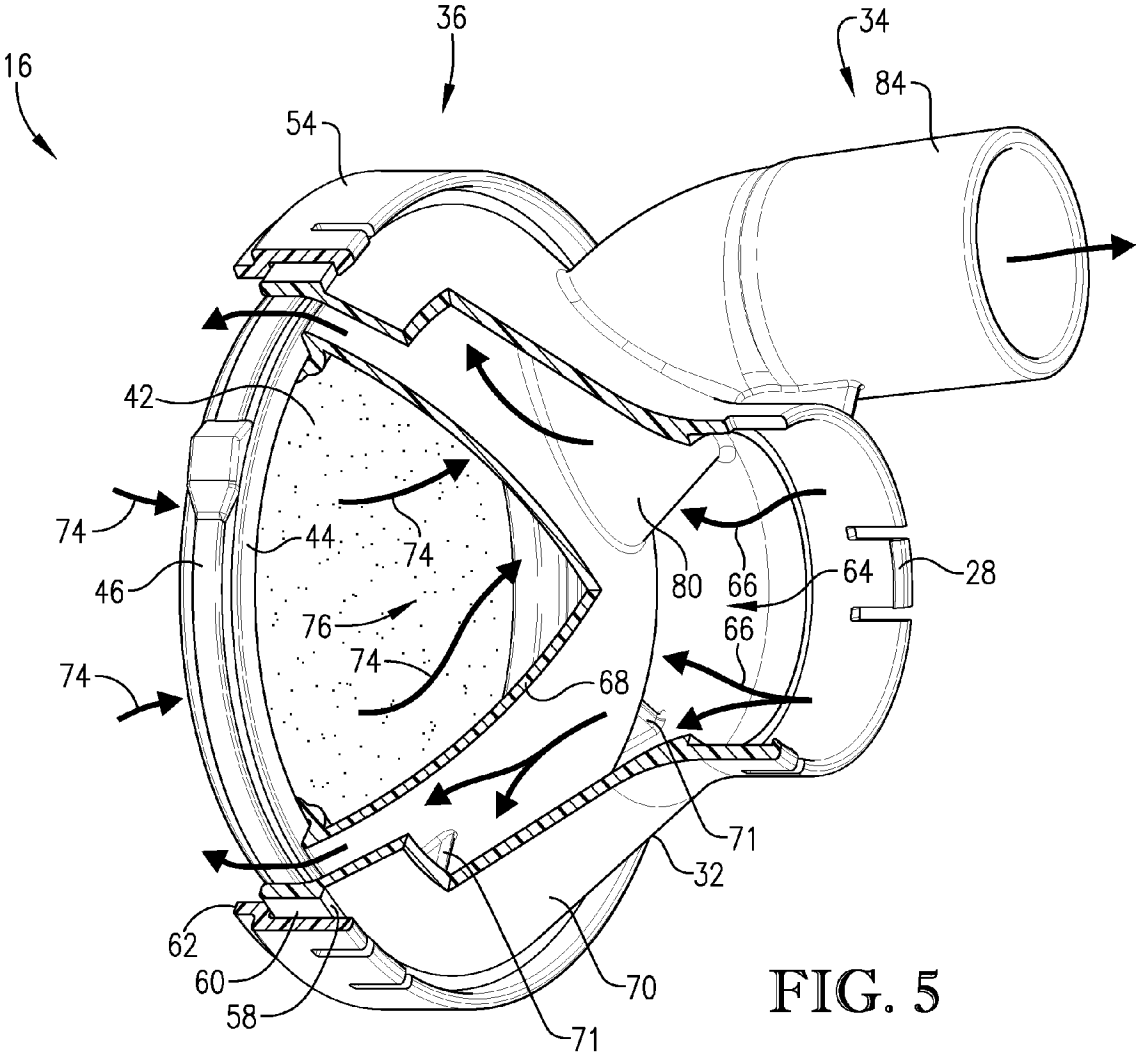
FIG. 5 is an alternate cross-sectional view of the device of FIG. 4.

A ring-shaped member 54 may be secured to housing 32 via a plurality of tabs 56 that are configured to engage shoulder 58 of an outer cylindrical wall section 60 (see, FIG. 5). Member 54 generally comprises a cylindrical sidewall 55 that includes tabs 56 and an inwardly disposed annular projection 57. Sidewall 55 and projection 57 cooperate to define a shoulder 59 that seats against the outer edge 61 of wall section 60 when member 54 is secured to housing 32. As best shown in FIG. 4, member 54 functions as an extension of wall section 60 so that the outboard edge 62 of member 54 is substantially even with hair-smoothing surface 52. However, member 54 may be substituted with alternate attachment rings, such as those shown in FIGS. 6 and 9, whose structure and function are described in greater detail below.

Figure 12:
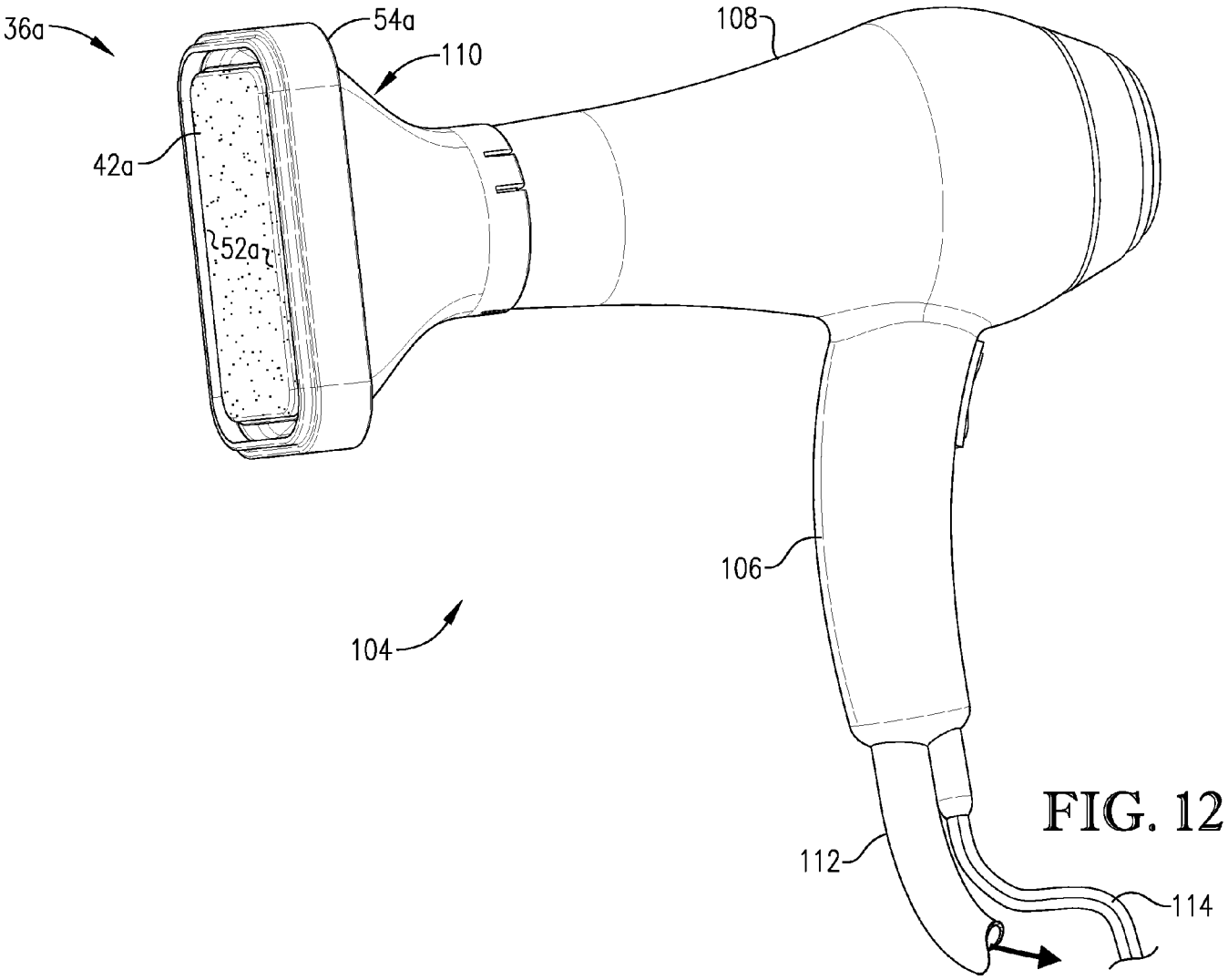
FIG. 12 is a perspective view of an alternate hair-treatment device made in accordance with the present invention.
Figure 13:
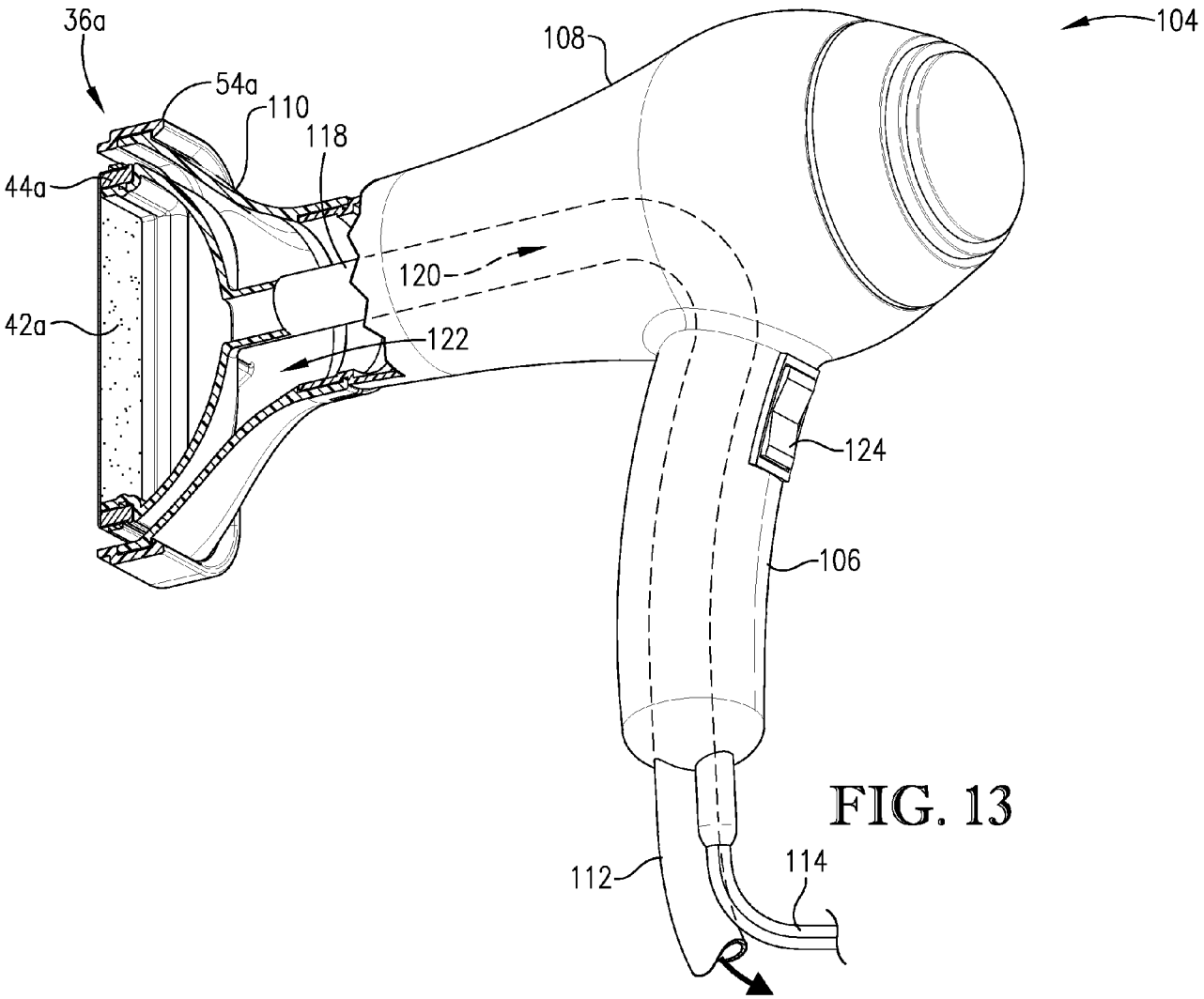
FIG. 13 is a partial sectioned view of the hair-treatment device of FIG. 12.

Attachment 16, and particularly second end region 36, is depicted as having a generally circular or round configuration. However, it is noted that attachment 16 can comprise any number of geometrical configurations without departing from the scope of the present invention. For example, in certain embodiments, the second end region 36 of housing 16 may present a generally rectangular, or even ovular configuration. FIGS. 12 and 13, which are described in greater detail below, illustrate one such alternate configuration.

FIG. 4 illustrates the internal air-handling structure of housing 32. Housing 32 comprises a passage 64 that interconnects first end region 34 and outlet 38. Passage 64 is operable to conduct a drying-air stream supplied by blower assembly 22 (represented by arrows 66) through housing 32. Passage 64 is defined, at least in part, by an internal concavo-convex wall 68 and an outer conical wall 70. Walls 68, 70 are interconnected by a plurality of spacer elements 71. As drying-air stream 66 exits nozzle 26, it impinges upon concavo-convex wall 68 and is diverted into an annular segment 72 of passage 64 located in the area of second end region 36.

After exiting outlet 38, a portion of the drying-air stream 66 may be delivered to hair 12 to effect removal of moisture therefrom. However, a portion of stream 66 may be pulled toward air intake 40 due to vacuum forces generated by vacuum assembly 20. Thus, vacuum assembly 20 induces the flow of a return-air stream (represented by arrows 74) causing the return-air stream to pass through element 42, thereby causing hair 12 to be drawn into contact with smoothing surface 52, as shown in FIG. 1. Thus, not only does element 42 prevent hair 12 from being drawn into attachment 16, it also flattens the hair while it is being dried so as to provide drying and smoothing functionality in a single step.

Return-air stream 66 enters air intake 40 and is directed through housing 32 via a passageway 76. In particular, passageway 76 is defined, at least in part, by inner cylindrical wall section 50 and concavo-convex wall 68. Moreover, at least a portion of passageway 76 is located inboard of annular segment 72. Hair-smoothing surface 52 faces away from passageway 76, which interconnects air intake 40 with first end region 34. Wall 68 presents an opening 78 and a tubular segment 80 extending therefrom. Tubular segment 80 is configured to conduct the return-air stream 74 toward first end region 34 and a return air outlet 82. As shown, first end region 32 comprises a port 84 that is configured to be connected with a flexible conduit, such as hose 86 that connects with control unit 18, and in particular, vacuum assembly 20.

Figure 7:
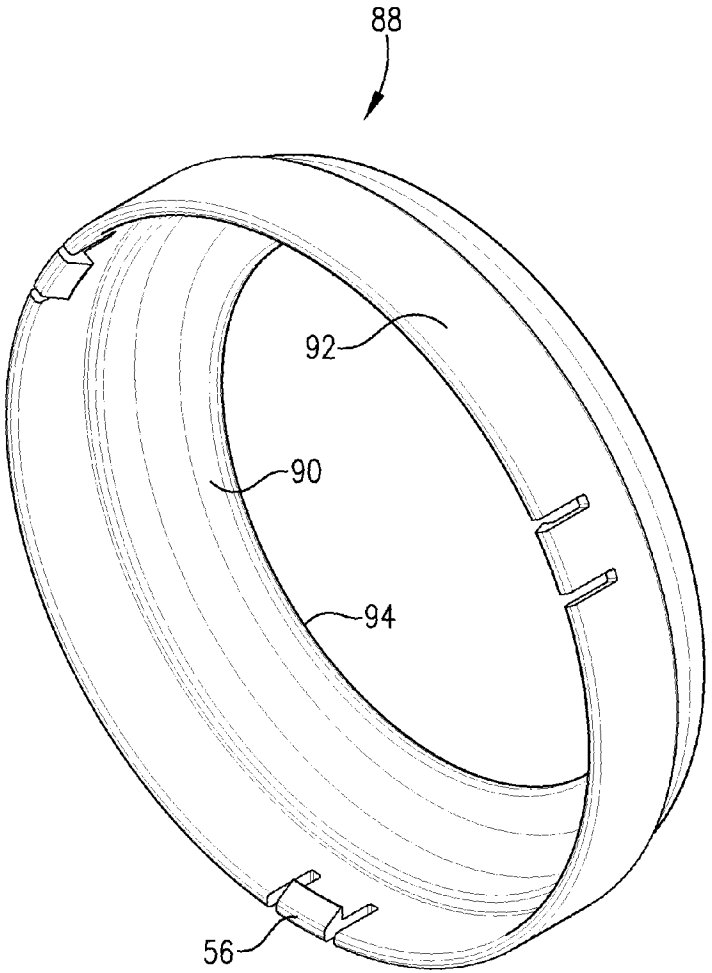
FIG. 7 is a rear perspective view of the air deflector attachment of FIG. 6.
Figure 6:
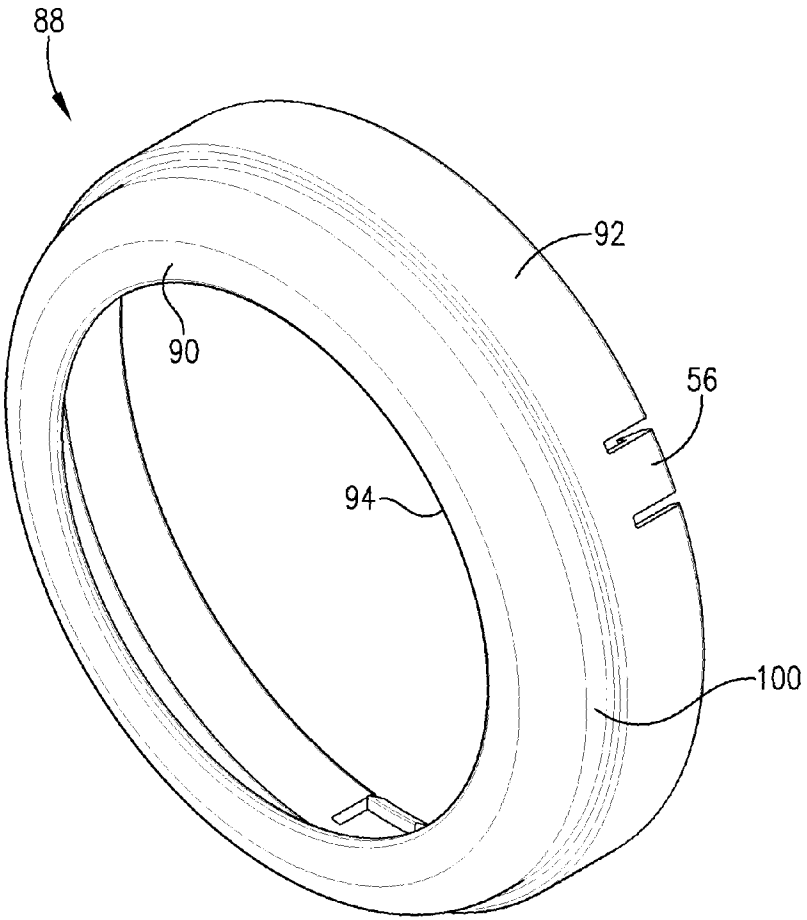
FIG. 6 is a front perspective view of an air deflector attachment for use with the device of FIG. 4.

Turning now to FIGS. 6-11, alternative embodiments for ring-shaped member 54 from FIGS. 3-5. FIGS. 6 and 7 illustrate a ring-shaped member 88 configured for attachment to outer cylindrical wall structure 60 of housing 32 via a plurality of tabs 56. Member 88 comprises structure configured to deflect the drying-air stream exiting outlet 38 toward the center of element 42 and air intake 40. A primary distinction between member 88 and member 54 is the presence of an annular lip 90 that extends inwardly from a circumscribing sidewall 92. Lip 90 defines a central member orifice 94 that, when member 88 is assembled onto housing 16, is in registry with air intake 40. Orifice 94 may comprise a smaller diameter than the orifice 63 defined by edge 62 of member 54.

Figure 8:
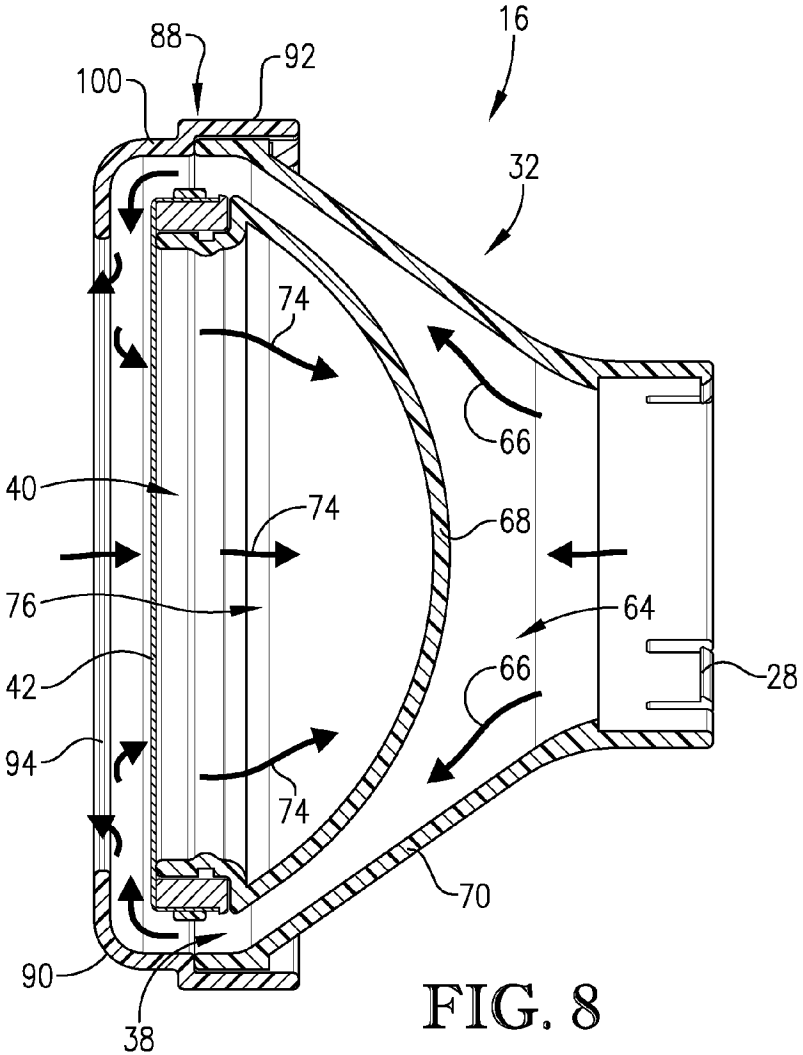
FIG. 8 is a cross-sectional view of the device of FIG. 4 with the air deflector of FIG. 6 attached thereto.

FIG. 8 illustrates the effect member 88 has on the flow of drying-air stream 66. As stream 66 moves through passage 64, it exists housing outlet 38 and is deflected by lip 90 thereby causing the stream to flow toward the center of element 42 and air intake 40. While some portion of stream 66 may escape to the surrounding environment, the deflection caused by lip 90 increases the volume of stream 66 that will be directed through air intake 40, under the motive force supplied by vacuum assembly 20, as return-air stream 74. Thus, member 88 causes the flow of streams 66 and 74 to be more circuitous than might be exhibited with member 54. In the apparatus equipped with member 54, a greater portion of stream 74 is likely to be drawn from the ambient air than from stream 66.

Figure 9:
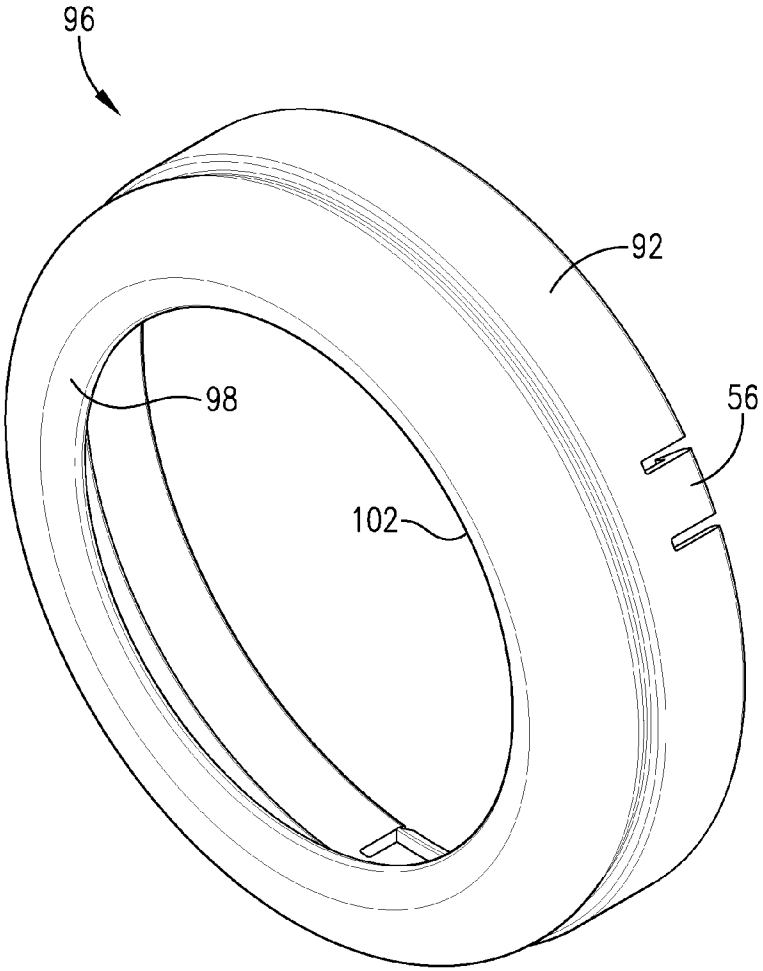
FIG. 9 is a front perspective view of an alternate air deflector attachment for use with the device of FIG. 4.
Figure 11:
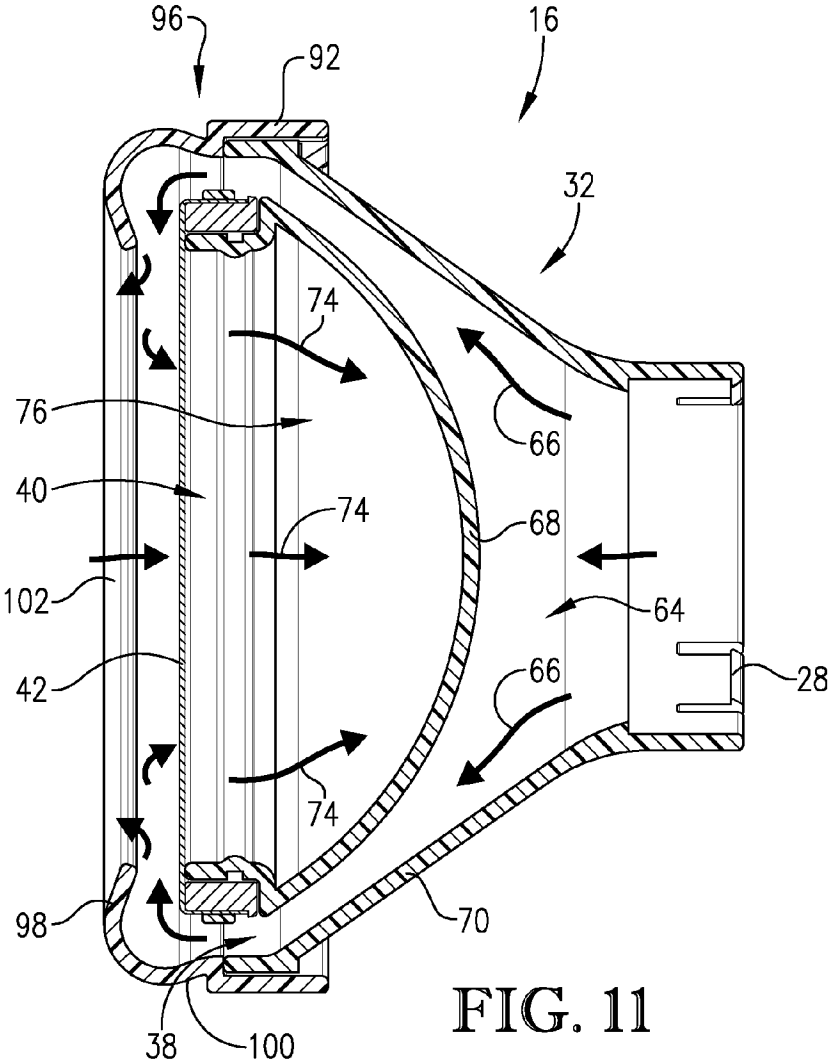
FIG. 11 is a cross-sectional view of the device of FIG. 4 with the air deflector of FIG. 9 attached thereto.
Figure 10:
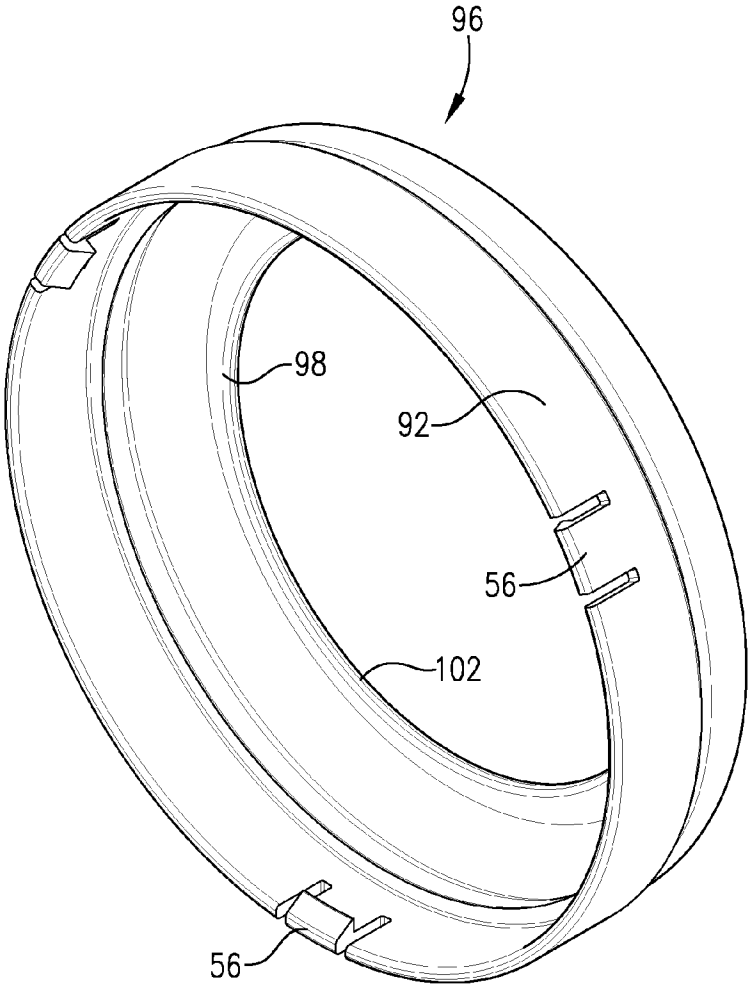
FIG. 10 is a rear perspective view of the air deflector attachment of FIG. 9.

FIGS. 9 and 10 illustrate a further embodiment of a ring-shaped member 96 configured for attachment to outer cylindrical wall structure 60 of housing 32. Member 96 is configured substantially the same as member 88 with the exception of lip 98. Whereas lip 90 of member 88 extends inwardly from annular projection 100 at an approximate 90° angle, lip 98 extends inwardly from projection 100 at an acute angle. Therefore, lip 98 not only directs drying-air stream 66 inwardly, but also downwardly toward element 42 and air intake 40. This flow of air is illustrated in FIG. 11. Thus, the configuration of member 96 assists in the recapture of an even greater volume of drying-air stream 66 as return-air stream 74. The central orifice 102 defined by lip 98 may be of the same diameter or less than that of orifice 94. It is further noted that in the case of members 88 and 96, lips 90 and 98, respectively, extend above and over the plane of element 42.

FIGS. 12 and 13 illustrate another embodiment of the present invention comprising a hand-piece device 104 that resembles a conventional hair dryer. Device 104 comprises a handle 106 secured to a device body 108, and a nozzle 110. In certain embodiments, nozzle 110 shares many structural and functional similarities with attachment 16 described above. These similar structures are marked with the same reference numerals used for FIGS. 1-11 with the extension "a" being used to differentiate between the two. It is readily noticeable that nozzle 110 comprises a second end region **36*a* that has a rectangular configuration. Likewise, support ring 44*a*, ring-shaped member 54*a* and smoothing surface 52*a* of smoothing element 42*a* also present a substantially rectangular configuration. The remaining structure of nozzle 110 and how the drying-air and return-air streams are handled are essentially the same as attachment 16. Device body 108 and nozzle 110 may be of unitary construction, or as illustrated, nozzle 110 may be detachable from body 108 to facilitate, among other things, easier cleaning and maintenance of the device. Device body 108 comprises a blower assembly (not shown), such blower assembly 22 as illustrated in FIG. 2, which also preferably includes a heating element like element 25, as may be found in a conventional hair dryer. The vacuum assembly 20 is located within a separate control unit, such as control unit 18 illustrated in FIG. 2**.

Interconnecting control unit 18 and body 108 is a tube 112 and an electrical cord 114 that extends from handle 106. Tube 112 is responsible for conduct of return-air stream 74 away from the device 104 under the motive force of vacuum assembly 20. Note, it is within the scope of the present invention for tube 112 to comprise a flexible tubing material, and in particularly preferred embodiments, tube 112 may comprise a collapsible, wire-reinforced hose. In other embodiments, cord 114 may be incorporated into tube 112, rather than being an independent component. Tube 112 and handle 106 may comprise respective fittings to permit easy attachment and detachment of the two units. Inside body 108 and nozzle 110, streams 66 and 74 are handled in a similar manner as described above. However, because the return-air stream 74 is being directed through body 108, nozzle 110 need not comprise a tubular segment 80 that projects outwardly from housing 32. Rather, an internal tubular segment 118 defines, at least in part, a passageway 120 that conducts return-air stream 74 within body 108 and nozzle 110. The on-board blower assembly provides the motive force for drying-air stream 66 that flows within passage 122. If desired, device 104 may be equipped with a switch 124 for selective operation of the blower assembly and heating element. However, as explained below, all such switches and controls may be located within control unit 18.

Referring once again to FIG. 2, various features of the control unit 18 are described hereunder. Control unit 18 generally comprises a case 126 that houses, among other things, vacuum assembly 20. Also included within case 126 is a bladder 128 that is in communication with hose 86 and operates to collect condensation from the return-air stream 74 prior to passage of the stream through the vacuum assembly. As apparatus 10 is generally used to both dry and smooth hair, the return-air stream 74 is likely to have a higher humidity level than drying-air stream 66 due to evaporation of moisture from the wet hair. Moreover, the heat that may be provided to drying-air stream 66 will have dissipated to some extent by the time the air enters hose 86 thereby possibly causing some of the moisture carried by return-air stream 74 to condense. Bladder 128 is provided so as to avoid directing this condensate through the fan and motor of vacuum assembly 20 and risk fouling thereof. In certain embodiments, bladder 128 may be removed from case 126 so as to periodically dump the condensate therefrom. In alternate embodiments, bladder 128 may be provided with a removable plug (not shown) so as to permit emptying thereof.

Control unit 18 may also be equipped with a power supply 130 that is capable of providing power for operation of vacuum assembly 20 and blower assembly 22. Power supply 130 includes an electrical cord 132 configured to be plugged into an electrical outlet. Cord 132 can be configured to retract within case 126 when not in use. In certain embodiments of the present invention utilizing a conventional hair dryer 14, the dryer power cord 134 may be plugged directly into control unit 18 at receptacle 136. A second receptacle 138 may also be provided on control unit 18 to permit the user to power other devices, such as other personal care or grooming devices. In embodiments in which control unit and 18 and the hand-held unit 14 are provided as an OEM system, such as with the embodiment of FIGS. 12 and 13, cord 134 may also be configured to retract into case 126 when unit 14 is not in use.

Control unit 18 may also be equipped with a timer 140 that may be pre-programmed or manually set to terminate the supply of power to one or both of receptacles 136, 138. For example, if the user were to plug a curling iron into receptacle 138, and forget to unplug the curling iron after use, timer 140 ensures that power to the curling iron is cut off after a length of time so as to reduce the risk of fire by an unattended device.

Control unit 18 may be provided with a number of switches or interfaces through which operation of vacuum assembly 20 and blower assembly 22 may be controlled. A button 142 may be provided for turning vacuum assembly 20 off and on, independently of the operation of blower assembly 22. Likewise controls 144 may be provided for adjusting the suction generated by vacuum assembly 20 when switched on (i.e., high, medium, or low settings). Button 146 can be employed to turn blower assembly 22 off or on, or to power on or power off heating element 25 independently from the motor and fan of blower assembly 22. Controls 148 can be used to selectively control the speed of the blower assembly fan, or the intensity of heat provided by heating element 25 (i.e., high, medium, or low). Finally, additional control buttons or switches 150 may be provided to control other aspects of control unit 18 operation, such as power to receptacles 136, 138, or to set timer 140.

In certain embodiments, case 126 may include a cradle 152 for receiving the hand-held unit 14 when not in use. To assist with storage of hand-held unit 14 in cradle 152, handle 154 may be hinged or collapsible, such as through an accordion-like connection. Moreover, tubing 86 may be collapsed and stored within case 126 when the apparatus 10 is not in use. Thus, the apparatus 10 may exhibit an overall aesthetically-pleasing design permitting storage of the apparatus in a visible area, e.g., on a countertop, rather than being stored in a drawer or cabinet. Moreover, case 126 in which the components of control unit 18 are located may be customizable by the end user to match the user's own personal preferences and decor. As apparatus 10 may be used in a bathroom, salon or other similar location, case 126 and the various buttons and controls may be sealed so as to prevent the entry of water that could lead to damage of the internal components of control unit 18.

Apparatus made in accordance with the present invention are particularly suited for use in methods of drying and smoothing hair. In one embodiment, a user of a device, such as apparatus 10, actuates blower assembly 22 so as to initiate flow of drying-air stream 66 and/or actuates vacuum assembly 20 so as to initiate flow of return-air stream 74. In certain embodiments, drying-air stream 66 is heated by heating element 25 to a temperature above ambient to expedite drying of the hair, although, the methods described herein can be practiced without this heating step if desired. Apparatus 10, and particularly hand-held device 14 is placed adjacent to the head of a person whose hair is to be dried and smoothed, so as to cause at least a portion of the hair to be brought into contact with element 42 return-air stream 74 generated by vacuum assembly 20. It is noted that actuation of blower assembly 22 and vacuum assembly 20 need not occur at the same time. In certain embodiments, the user may first actuate blower assembly 22 and contact the subject's hair with element 42 so as to at least partially dry the hair before beginning smoothing operations. Alternatively, the user may first actuate vacuum assembly 20, and refrain from actuation of blower assembly 22, especially if the hair is only mildly damp and very little additional drying is needed. In certain embodiments in which both blower assembly 22 and vacuum assembly 20 are operated simultaneously, at least a portion of the drying-air stream 66 is directed past a portion of the hair in contact with element 42 to effect further drying thereof.

Upon actuation of at least one of vacuum assembly 20 and blower assembly 22, the hand-held device 14 is then traversed over the hair in a sweeping, or substantially linear, motion toward the ends of the hair thereby simultaneously drying and smoothing the hair. This traversing of device 14 over the hair may be repeated a plurality of times until the hair has reached the desired state of dryness and straightness. As noted above, control unit 18 includes a bladder 128 that is operably coupled with vacuum assembly 20. In certain methods, condensation from return-air stream 74 is collected in bladder 128, which is then periodically drained.

I claim:

1. A hair-treatment device comprising:

a housing having a first end region configured for attachment to a blower assembly capable of supplying a drying-air stream to said device, and a second end region comprising an outlet for the drying-air stream supplied by said blower assembly and an air intake for directing a return-air stream into said housing, said housing including a passage interconnecting said first end region and said outlet through which the drying-air stream supplied by the blower assembly is conducted, said housing including a passageway interconnecting said air intake with said first end region through which the return-air stream is conducted within said device, said first end region further comprising structure configured for attachment to a vacuum assembly that is external to said hair-treatment device; and a smoothing element disposed in covering relationship to said air intake and having a hair-smoothing surface facing away from said passageway.

2. The hair-treatment device according to claim 1, said hair-smoothing surface being substantially planar, and said smoothing element being substantially devoid of structure extending outwardly past said hair smoothing surface.

3. The hair-treatment device according to claim 1, wherein said passage comprises an annular segment located in the area of said second end region.

4. The hair-treatment device according to claim 3, wherein at least a portion of said passageway is located inboard of said annular segment.

5. The hair-treatment device according to claim 1, wherein said first end region includes a port that is configured to be connected with a vacuum apparatus operable to induce the flow of the return-air stream through said passageway.

6. The hair-treatment device according to claim 1, wherein said smoothing element is secured to a removable support ring.

7. The hair-treatment device according to claim 6, wherein said passageway is defined, at least in part, by a tubular wall section located proximate said air intake, said tubular wall section configured to engage said support ring and secure said smoothing element to said housing.

8. The hair-treatment device according to claim 1, wherein said passageway is defined at least in part by a concave surface of a concavo-convex wall, said concavo-convex wall including an opening and a tubular segment extending therefrom configured to conduct the return-air stream toward said first end region.

9. The hair-treatment device according to claim 1, wherein said device further comprises an air deflector configured to be releaseably attached to said housing adjacent said second end region and operable to cause at least a portion of the drying-air stream to be deflected toward said air intake.

10. The hair-treatment device according to claim 1, wherein said smoothing element comprises a textile material.

11. The hair-treatment device according to claim 1, said outlet comprising an annulus defined at least in part by circumscribing outboard and inboard sidewalls of said housing, said passageway being located inboard of said annulus, and said smoothing element being secured to said inboard sidewall of said housing.

12. A method of drying and smoothing hair comprising:

actuating a vacuum assembly that is attached to the hair treatment device according to claim 1 so as to generate said return-air stream;

placing said device adjacent to the head of a person whose hair is to be dried and smoothed, so as to cause at least a portion of said hair to be brought into contact with said smoothing element by said return-air stream generated by said vacuum assembly; and traversing said device over said hair in a substantially linear motion toward the ends of the hair thereby simultaneously drying and smoothing said hair.

13. The method according to claim 12, wherein said method further comprises actuating said blower assembly so as to generate said drying-air stream, at least a portion of said drying-air stream being directed past at least a portion of said hair in contact with said smoothing element to enhance drying of said hair.

14. The method according to claim 12, wherein said vacuum assembly is contained with a control unit, said control unit further comprising a bladder operably coupled with said vacuum assembly, and wherein said method further comprises collecting condensation from said return-air stream in said bladder.

15. The method according to claim 12, wherein said outlet comprises an annulus defined at least in part by circumscribing outboard and inboard sidewalls of said housing, said passageway being located inboard of said annulus, and wherein said method further comprises:

actuating said blower assembly so as to supply a drying-air stream to said device and directing said drying-air stream through said annulus;

conducting said return-air stream generated by said vacuum assembly through said passageway; and securing said smoothing element to said inboard sidewall of said housing.

* * * * *